United States Patent [19]

Leggett et al.

[11] Patent Number: 4,938,290

[45] Date of Patent: Jul. 3, 1990

[54] WIRELINE BLOWOUT PREVENTER HAVING MECHANICAL AND HYDRAULIC SEALING

[75] Inventors: Henry H. Leggett, Longview, Tex.; Lionel M. Gingras, Setia Mansion, Singapore

[73] Assignee: Eastern Oil Tools PTE LTD

[21] Appl. No.: 367,782

[22] Filed: Jun. 19, 1989

[51] Int. Cl.[5] ..... E21B 33/02

[52] U.S. Cl. ..... 166/387; 251/1.1; 277/31

[58] Field of Search ..... 166/387; 277/31; 251/1.1, 1.3

[56] References Cited

U.S. PATENT DOCUMENTS 4,227,543 10/1980 Williams, Jr. ..... 251/1.3 X 4,529,210 7/1985 Biffle ..... 277/31

*Primary Examiner*—William P. Neuder

*Attorney, Agent, or Firm*—James L. Jackson

[57] ABSTRACT

A single ram unidirectional wireline BOP system is provided having both mechanical and hydraulic sealing capability. A BOP body having a vertical flow passage and intersecting horizontal ram passages includes a single pair of opposed rams and appropriate actuators for moving the rams into sealing engagement with a wireline extending through the vertical flow passages. Each of the rams incorporates an elastomeric peripheral seal extending about a major portion of the periphery thereof and disposed for sealing engagement with internal wall surfaces of the body. The sealing system of the rams also incorporates a pair of vertically spaced inner elastomeric seals disposed for sealing engagement with one another and with the wireline. Between the upper and lower inner seals in the closed positions of the rams, is defined a small, centralized grease chamber through which the wireline extends. The body of the BOP incorporates a grease fitting for injection of grease into the grease chamber for hydraulic sealing about the wireline. Both the rams incorporate a relief valve controlled pressure relief system for relieving excess grease pressure to the upstream portion of the flow passage of the BOP. The BOP also incorporates a valve controlled pressure equalizing system to permit selective pressure equalization across the seals developed by the upper and lower inner sealing elements to thus reduce pressure energized frictional forces and permit the rams to be easily moved from the closed position towards the open positions thereof.

18 Claims, 2 Drawing Sheets

WIRELINE BLOWOUT PREVENTER HAVING MECHANICAL AND HYDRAULIC SEALING

FIELD OF THE INVENTION

This invention is related generally to blowout preventers and more specifically concerns blowout preventers designed specifically for sealing about the wireline of wireline tools such as are utilized for conducting well servicing operations. Even more specifically, this invention concerns a wireline blowout preventer that incorporates mechanical sealing for establishment of a seal about a wireline and hydraulic sealing for sealing the interstices that exist between the armor strands of a typical wireline.

BACKGROUND OF THE INVENTION

After a well has been drilled such as for discovery and production of petroleum products, wireline controlled apparatus is frequently employed to conduct various downhole installation, retrieval and servicing operations. Wireline equipment is utilized to install and retrieve a wide variety of downhole tools such as packers, gas lift valves, downhole safety valves, bottom hole pressure sensors and the like. Wireline equipment is also frequently utilized to run various well servicing tools such as for cleaning and treating production tubing.

At times it is desirable to establish a seal about the wireline to permit well servicing operations to be conducted within the well head and free of well pressure above the blowout preventer (BOP). More importantly, wireline BOP's are required to accommodate various emergency situations and alleviate any dangerous condition that might otherwise occur. During wireline operations the wireline BOP is typically static in an open position which allows the wireline to freely traverse the wellhead of the well without interference with any portion of the wellhead structure including the safety equipment of the wellhead.

At times during well servicing operations it will be necessary to close and seal the wireline BOP about the wireline. For example, in the event a kick develops in the open hole or in the casing of the well, the wireline BOP is closed to develop a seal to contain well pressure and prevent a blowout. With well pressure thus contained kill fluid to be pumped into the well below the seal established by the wireline BOP to shut in the well. The wireline BOP may also be closed to temporarily maintain well pressure while bleeding off the lubricator of wireline equipment to replace packoff elements. In some cases it becomes necessary to remove, add or make repairs to the riser or cable of the wireline well servicing equipment. In this case the wireline BOP is typically closed and sealed about the wireline cable to thus permit cable repairs to be made above the level of the wireline seal. Most critically, wireline BOPs are shut automatically or manually in the case of failure of the well control system above the level of the BOP.

Typically, wireline sealing elements are formed by two elastomer faced metal rams which have been contoured to fit a particular size of wireline cable. These rams are positioned in opposed relation and are actuated such that they establish sealing engagement with the wireline positioned centrally of the BOP housing. In other words, the opposed rams center the wireline within the housing and establish a seal about the wireline. The opposed rams are closed manually or hydraulically (with mechanical backup) to shut in the well.

When the BOP is activated, the elastomer faces of the rams will seal around the outer surface of the cable by extruding the elastomeric material into the interstitial spaces between the armor strands of the wireline.

Ram type BOPs are designed to seal with the wireline cable in a static position. It is necessary therefore to always stop movement of the wireline before the rams are closed about the wireline to effect sealing. Short lengths of wireline cable can be stripped through the BOP as needed to repair a stranded cable but the amount of elastomeric material that can be worn away by such stripping without resulting in leakage of the BOP is limited. Pulling an appreciable length of wireline cable through the BOP will induce severe wear to the elastomeric seals of the rams and can cause damage to the rams as well, causing a more serious failure.

The highly pressurized elastomeric seal is prevented from extrusion by the close metal-to-metal fit of the ram faces and due to the fact that differential pressure moves the cylindrical rams tightly against the upper wall of the BOP housing. When the pressure of the elastomer against the surrounding surfaces of the BOP body exceed differential pressure a leak-tight seal will be effected. Wireline BOPs are designed to seal against well pressure in only one direction and therefore care must be taken to insure that they are not installed upside-down when a single set of rams is employed because the BOP will not hold well pressure. Single ram BOPs are only installed upside-down to contain pressure injected from above.

It is difficult to move the rams of wireline BOPs when the rams are closed against high differential pressures. Wireline BOPs must therefore be provided with a bypass that is used to equalize the pressure across the rams before opening of the rams is initiated. After equalization of well pressure across the rams has occurred there will be a partial relaxation of the sealing contact of the elastomeric seals with the wireline, thus reducing the extrusion of the elastomeric sealing material about the wireline and con. The effective reduction of friction makes the rams much easier to open. To allow a controlled equalization of pressure, the BOP is typically fitted with a pressure equalizing system.

Manual BOPs are operated by turning two ram operator handles on opposed sides of the apparatus to open and close the opposed rams. Manual BOP's are available in a number of sizes and ratings. Regardless of the pressure rating, they are normally used at lower pressures for standard service. Manual BOPs are typically of lighter weight and are less expensive as compared to BOPs having hydraulically energized rams. Because operating personnel must gain physical access to manual BOPs for opening and closing the rams, such personnel is typically in a more dangerous location during these activities. Also, less ram pressure can be applied with manual BOPs than with hydraulically engergized ram BOPs. In larger sizes, as commonly used for open hole work, the manual BOP offers adequate protection and is considerably lighter than a hydraulically energized BOP.

Hydraulic ram BOPs are opened and closed by hydraulic pressure acting on pistons in hydraulic cylinders. Hydraulic BOPs also have handles and stems that are used for manual backup. A hydraulic BOP can be closed manually but must be opened hydraulically. The stems must be backed out manually before the rams can be opened hydraulically.

The rams and sealing elements of wireline BOPs have grooves that are sized for the wireline cable diameter being employed. As the rams are closed, the cable is guided by the rams or other cable guide elements into the grooves of the sealing elements. BOPs are provided with "integral guide" rams that prevent cable damage as the cable is guided and centralized during ram closure. If the rams of hydraulic wireline BOPs are to be left closed for a long period of time or in case of hydraulic failure, the manual screw jack can be used to hold the rams in the closed position. To open a hydraulic wireline BOP, the mechanical backup must be in the open position before shifting the "selector" to its open position and hydraulically pumping the rams to their open positions.

Multiple ram BOPs, typically dual wireline BOPs, are utilized to provide a backup in case of failure of the primary set of sealing rams. More importantly is the fact that gas will migrate through the interstices between the inner and outer armor in wireline cables. In the event that the lubricator of the wireline equipment would need to be removed for some reason, the leaking gas would quickly present a significant problem from the standpoint of danger to personnel. To alleviate this problem, a second (tandem) BOP is added. This BOP is inverted (because wireline BOPs hold pressure in only one direction) and a port is added between the two BOPs. High pressure grease (above well pressure) is injected into the flow passage between the upper and lower sets of rams. Under high pressure, the grease is caused to migrate into the interstitial space between the inner and outer armor of the wireline and thereby effects a grease seal to prevent gasses from escaping. In some cases a triple BOP is also available which provides a backup in the case of primary ram failure. A triple BOP also provides a method for injection of grease between the BOPs if needed. Multiple ram BOPs are available in a single forged body for lighter weight and more compact size.

As explained, it is frequently necessary to employ dual and sometimes triple wireline BOPs and to provide for grease injection between them in order to effect a proper wireline seal and prevent migration of gasses through the interstices of the wireline. Since the flow passage between the stacked or multiple wireline BOPs is typically of significant length and is at least as great as the diameter of the flow passage through the wireline, a considerable volume of injected grease is necessary to accomplish efficient sealing. Also, injection of a sufficient volume of grease to fill the flow passage and develop a hydraulic seal with the wireline can require a considerable period of time. It is desirable to minimize the time required to develop an adequate hydraulic seal with the wireline to thus promote the safety of the sealing operation. Obviously, employment of dual and triple ram BOPs whether of the manual or hydraulic type can result in considerable expense Moreover, the stacking of dual and triple wireline BOPs ordinarily results in a BOP riser of significant height. In many cases there is little room to accommodate multiple wireline BOPs of this nature. Accordingly, it is desirable to provide a single ram wireline BOP having the capability of providing both elastomeric sealing by means of opposed rams and to provide hydraulic sealing by means of grease injection.

It is therefore a primary feature of the present invention to provide a novel single ram wireline BOP, whether energized manually or hydraulically, which achieves an efficient mechanical seal about braided wireline to efficiently contain well pressure below the rams.

It is also a feature of this invention to provide a novel single ram wireline BOP that has the capability of grease injection about the wireline to thus provide an additional hydraulic seal about the wireline cable to prevent the flow of gasses through the interstices formed by the armor of the cable.

It is an even further feature of this invention to provide a novel single ram wireline BOP incorporating both mechanical and hydraulic sealing and wherein hydraulic sealing is effected quickly by means of a minimal volume of injected grease.

SUMMARY OF THE INVENTION

The principles of the present invention are realized in the provision of a grease injection type wireline blowout preventer having only a single set of opposed blowout preventer rams as compared with dual and triple ram BOPs such as have been employed in the past. The wireline BOP of the present invention incorporates a body structure having opposed ram actuators each having driving connection with one of the two internal rams of the BOP apparatus. The actuator mechanisms may be of the manually operated variety as shown in FIG. 1, or, in the alternative, may conveniently take the form of hydraulically energized BOP operators with manual backup.

Each of the rams is basically composed of a suitable metal such as steel, stainless steel, etc. and incorporates elastomer and metal inserts that are typically integral with the rams and disposed for movement along with the rams into sealing engagement with a wireline that extends through the flow passage of the BOP body. The rams are so designed that a grease sealing chamber is developed between upper and lower elastomer seals of the rams when the rams are in sealing assembly with the wireline. This grease sealing chamber is of small dimension and is capable of containing only a small amount of grease or other suitable sealing material. A grease injection valve is in assembly with the body structure of the BOP and receives grease or any other suitable sealant from a source such as a hydraulic hand pump or a hydraulically or electrically energized grease injection pump. The grease injection valve is a unidirectional valve disposed in communication with the grease sealing chamber and thus permits grease to be injected about the wireline with sufficient force to enter the interstices of the wireline and establish a grease seal that enhances the mechanical seal established by the elastomer sealing elements of the rams.

Each of the rams incorporate a vent or bleed passage having a check valve assembly for venting gas or liquid from the grease sealing chamber as grease is injected into the chamber for sealing. The check valve assembly and passages of the bleed or vent system permit displaced gas or liquid to flow into the upstream flow passage of the BOP apparatus. The unidirectional sealing capability of the BOP apparatus insures the development of a downstream seal while the BOP lacks an upstream seal and permits fluid interchange pass the check valve assembly into the upstream portion of the BOP.

The BOP system also incorporates an equalizing valve assembly permitting controlled equalization of pressure of the upstream and downstream flow passages even when the BOP is maintained in sealed relationship with the wireline via the closed rams and the pressurized grease within the grease sealing chamber. The equalizing valve assembly is defined by bypass passages formed by piping or by any other means and by a single valve to control the communication of pressure through the bypass passages.

There is thus provided a wireline blowout preventer system incorporating a single pair of opposed rams that have unidirectional sealing capability about a wireline by means of elastomeric seals. The apparatus also incorporates in this single BOP ram assembly a grease sealing capability permitting high pressure injection of grease into a central grease chamber formed between upper and lower seals of the rams to thus permit hydraulic sealing of the interstices of the wireline. This apparatus accomplishes in a single BOP ram assembly the features that are ordinarily provided in dual and triple BOP systems.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a sectional view of a wireline blowout preventer mechanism constructed in accordance with the principles of this invention and incorporating both mechanical and hydraulic sealing about the wireline.

FIG. 2 is a sectional view taken along line 2—2 of FIG. 1 and which illustrates the grease injection system and equalizing valve system of the wireline blowout preventer in detail.

DETAILED DESCRIPTION OF PREFERRED EMBODIMENT

Figure 1:
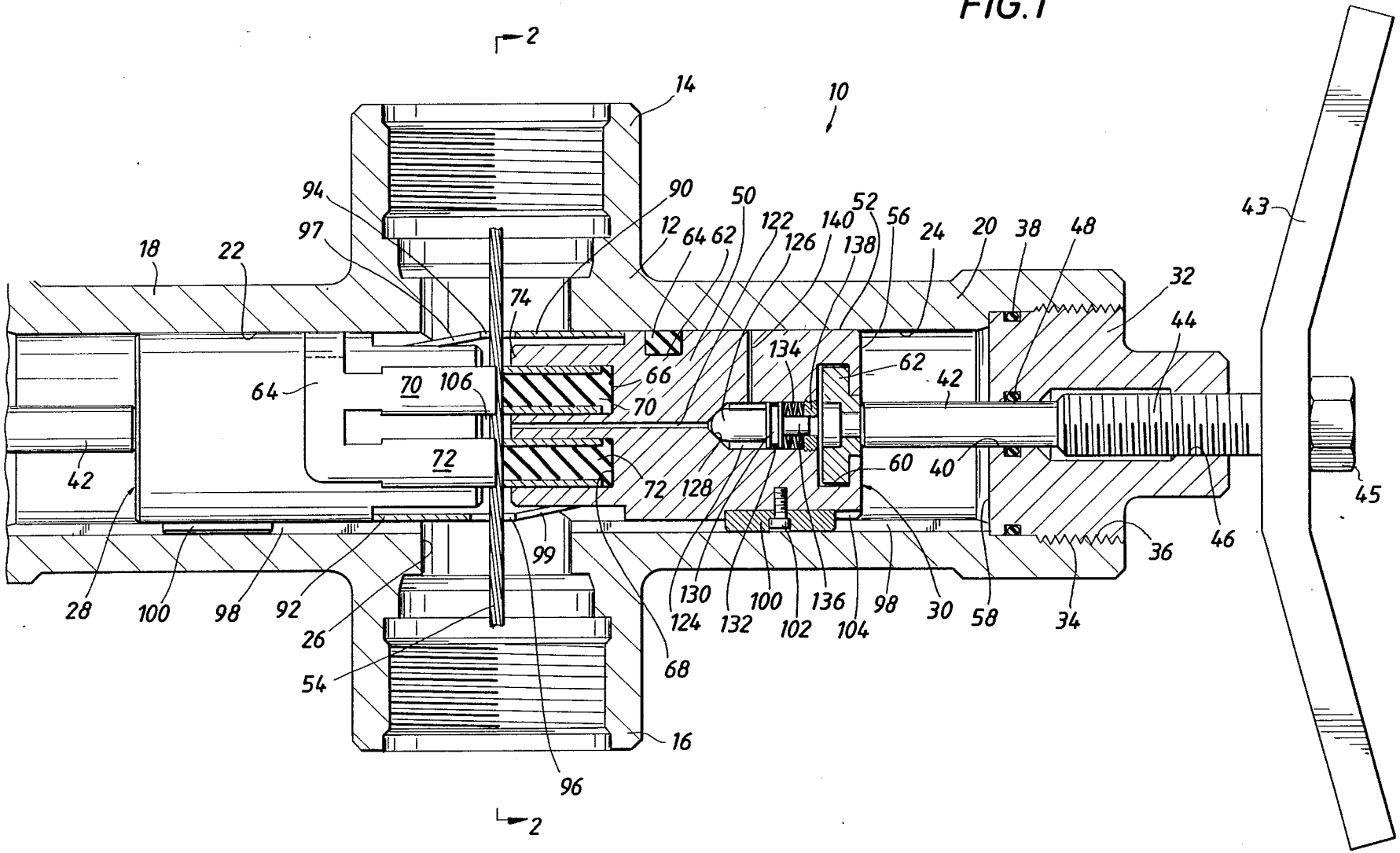

Referring now to the drawings and first to FIG. 1, a single ram grease pack BOP system is illustrated generally at 10 which incorporates a BOP body structure 12 having upper and lower connections 14 and 16 for assembly of the BOP into wellhead apparatus or into respective upper and lower components of a wireline barrel. Although the vertical connectors 14 are shown to be internally threaded such as for threaded connection to other components of the wireline barrel and wellhead structure such is not intended to limit the spirit and scope of the present invention. Other forms of connection may be efficiently utilized without departing from the spirit and scope of this invention. The body structure of the blowout preventer also defines opposed horizontal tubular ram housings 18 and 20 which define generally cylindrical internal passages 22 and 24 respectively. These internal passages are disposed in intersecting relation with a vertically oriented flow passage 26 which is defined by the body structure. Within the passages 22 and 24 are provided a pair of ram assemblies shown generally at 28 and 30 which are disposed for controlled reciprocation by means of ram operators. Since the ram operators may be substantially identical and are preferably identical in construction, only one of the ram operators is shown at the right hand portion of FIG. 1. Each ram operator incorporates an end cap 32 which is coupled with the respective horizontal tubular ram housing elements 18 and 20 in any suitable fashion. As shown in FIG. 1 the end cap 32 is provided with an externally threaded section 34 which is received by internal threads formed within the outer end portions of the respective tubular ram housing elements. The end cap is sealed with respect to the tubular element 20 by means of a circular sealing element 38. A stem passage 40 is defined by the end cap 32 and forms a passage through which a ram actuating stem 42 extends. A handle 43 is releasably secured to the actuating stem by a nut 45 and provides for manual rotation of the actuating stem to open or close a respective ram. The outer portion of the stem 42 is provided with an externally threaded section 44 which is received by internal threads 46 of the end cap. Thus, rotation of the stem 42 relative to the end cap induces linear movement to the ram actuating stem 42 and to the BOP ram interconnected therewith. A seal between the ram actuating stem 42 and the end cap 32 is established by means of a circular elastomeric sealing element 48.

The cylindrical passages 22 and 24 formed by tubular portions 18 and 20 of the body structure 12 receive the opposed rams 28 and 30 in movable relation therein. Each of the rams is provided with a pressure relief assembly. As shown the BOP ram 30 incorporates a ram body structure 50 which is of generally cylindrical configuration and which defines a cylindrical outer surface 52 having a reasonably close fit within the cylindrical passage 24. The ram body 50 is movable to a closed position as shown in FIG. 1 where the ram cooperates with ram 28 and establishes a gripping and mechanical sealing relation with a wireline 54 that extends through the flow passage 26 of the BOP. The ram 30 is also movable to an open position where the ram body 50 is retracted by the operating stem 42 to a position at which the gripping and sealing relation with the wireline 54 is released. In its full open position, the ram body 50 is positioned with its end surface 56 in engagement with a restraining surface 58 defined by the end cap 32.

Each of the rams 28 and 30 is connected to its respective ram actuating stem 42 in similar fashion. The rear end portion of the ram body 50 defines an undercut slot 60 which receives an enlargement 62 provided at the inner end of the ram actuating stem 42. Thus, as the ram actuating stem is retracted by the operator toward its open position, retraction force between the actuating stem and the ram body 50 is transmitted from the stem 42 and the enlargement 62 to the end structure of the ram body.

Each of the rams 28 and 30 is provided with inner and outer sealing elements for establishment of a seal between the BOP and the wireline and also to establish downstream seals between the rams and the inner surface of the BOP body 12. Each of the ram bodies defines an outer seal groove 63 which may be of generally rectangular cross-sectional configuration as shown and which extends about more than 180° of the periphery of the ram body. Within this partial circumferential groove 63 is provided a body of sealing material 64 which fills the groove and which is operable to establish sealing engagement with the inner cylindrical surfaces 22 or 24 forming the opposed ram passages of the BOP body structure. Each of the ram bodies 50 also forms spaced upper and lower inner seal receptacles 66 and 68 which open forwardly toward the wireline 54 and which also open laterally of the ram body. Upper and lower elastomeric ram seals 70 and 72 are disposed within the receptacles 66 and 68 and project beyond the respective ends 74 of the ram body for sealing engagement with the wireline 54. The upper and lower inner seals 70 and 72 are preferably formed integrally with the outer seal 64 such as by means of a molding operation. This feature prevents any leak path from being developed between the outer seal 64 and the spaced upper and lower inner seal 70 and 72. It should be born in mind, however, that the inner and outer seals of the BOP structure may take any other suitable form without departing from the spirit and scope of the present invention.

Figure 2:
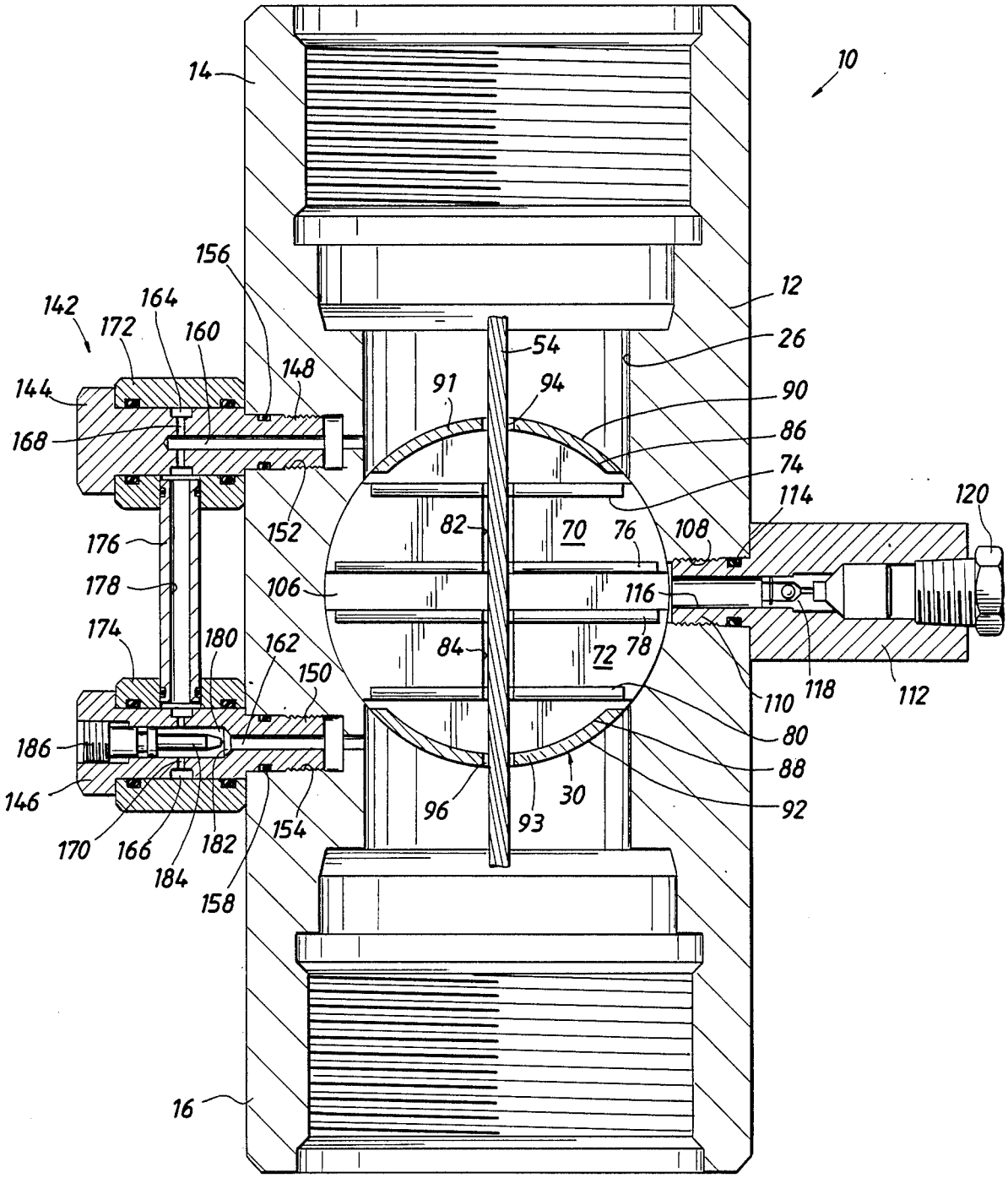

Within each of the inner seal receptacles 66 and 68 are provided pairs of spaced seal support plates which provide the spaced inner seals 70 and 72 with sufficient structural integrity to resist the force of pressure differential that might otherwise permit sufficient yielding of the elastomeric sealing material to allow leakage to occur. As shown in FIG. 2 the upper inner seal 70 is provided with seal support plates 74 and 76 while the lower inner seal 72 is supported by upper and lower seal support plates 78 and 80. As is also evident from FIG. 2 the upper and lower inner seals 70 and 72 and their respective seal support plates define upper and lower vertical groove sections 82 and 84 within which the wireline 54 is received and which are of appropriate dimension to permit effective sealing with a wireline of particular dimension.

It is desirable to provide the rams 28 and 30 with a wireline guiding function to insure proper centralization of the wireline within the flow passage 26 so that the ram slots 82 and 84 will establish proper orientation of the vertical wireline slots 82 and 84 as the rams are closed to establish efficient sealing and gripping relation with the wireline. The inner portions of the ram bodies are recessed as shown at 86 and 88 and receive ram guide elements 90 and 92. The ram guides each define oppositely disposed inclined guide surfaces 91 and 93 which cause the wireline 54 to be centralized within the flow passage 26 and properly positioned with respect to the upper and lower wireline receptacles 82 and 84 of the upper and lower seals. The wireline guide elements 90 and 92 each define wireline receptacles 94 and 96 which receive the wireline when it is properly positioned in the respective wireline grooves of the upper and lower sealing elements.

As the rams 28 and 30 are reciprocated during opening and closing movement thereof, they are guided and prevented from rotating within the respective passages 22 and 24. The ram body 12 defines elongated horizontal keyways 98 in the lower portion of the tubular housing elements 18 and 20. These keyways receive guide keys 100 which are secured to the respective ram bodies 50 by means of cap screws 102 or by any other suitable means of connection. The ram bodies define slots or recesses 104 within which the respective ram keys 100 are located.

The wireline 54 includes twisted armor strands forming the outer portion thereof and defines interstitial spaces or voids between the armor strands through which pressure passes even when the rams are closed and sealed about the wireline. Obviously leakage of combustible fluid such as natural gas past the BOP seal can present significant hazard to workers and equipment in the immediate vicinity. Leakage of this character is avoided if grease or other sealing material is injected or extruded into the interstitial spaces. As mentioned above, twin and triple BOP systems are ordinarily employed to effect grease sealing of the wireline between the rams of upper and lower BOPs. According to the present invention, the BOP incorporates a single pair of opposed rams to provide efficient mechanical sealing between the elastomeric material and the wireline and between the rams and the body structure of the BOP. Additionally, a small centralized grease sealing chamber 106 is formed between the upper and lower inner seals of the wireline BOP assembly when the rams are closed as shown in FIG. 1. Since the grease sealing chamber 106 is of relatively small dimension, only a small quantity of injected grease is required to establish protective hydraulic sealing of the interstices of the wireline. As shown in FIG. 2, the body structure 12 of the BOP defines an internally threaded opening 108 which receives the externally threaded connector portion 110 of a grease injection fitting 112. The fitting 112, which is sealed with respect to the body 12 by means of a circular sealing element 114, defines an injection passage 116 through which grease is injected from the fitting 112 into the grease receptacle or chamber 106. The fitting 112 also incorporates a check valve assembly 118 which insures that the grease injection fitting 112 is unidirectional to permit the flow of grease into the sealing chamber 106 to prevent the flow of grease from the sealing chamber. The grease fitting 112 is normally provided with a threaded plug 120 for closure thereof. For injection of grease through the grease fitting, the plug 120 is removed and a source of injected grease such as a hand pump is threaded in its place. Also, if desired, the plug 120 may be eliminated and a lubricant supply line may be connected to the grease fitting 112 for injection of grease from a remote source through the injection line and grease fitting into the chamber 106.

Both of the rams 28 and 30 the wireline BOP assembly are provided with a check valve assembly for the purpose of relieving excess pressure from the grease sealing chamber 106. The structure shown in ram body 50 exemplifies the pressure relief system of ram 28 as well. As shown in FIG. 1, the ram body 50 defines a relief passage 122 which communicates the grease chamber 106 with a check valve chamber 124 having a check valve piston 126 movably disposed therein. The wall structure of the ram body forms a tapered internal valve seat 128 against which the rounded end of the check valve piston is adapted to seat. The check valve defines a circular seal groove 130 within which is positioned a circular elastomer sealing element 132 such as an O-ring or the like. The check valve also defines a thrust shoulder against which is seated a spring or spring package 134 which is disposed about an axial valve guide stem 136 defined by the check valve structure and which is retained in compression by means of a circular retainer element 138. The retainer 138 is threadedly connected within the valve receptacle of the ram body and is adjustable to vary the compression of the spring package 134 as is appropriate to retain the valve piston under sufficient force against the valve seat 128 to prevent bleeding of pressure from the chamber 106 under normal grease sealing pressure conditions. In the event fluid pressure within the chamber 106 becomes excessive such as when excessive grease is injected into the chamber 106, the build-up of excessive pressure acts against the check valve 126 and develops sufficient force to overcome compression of the spring package 134 and force the check valve 126 rearwardly. The relief valve 126 is thus unseated from seat 128 permitting pressure to bypass the check valve whereupon excess pressure is vented from the valve chamber 124 to the upstream side of the BOP ram assembly via a vent passage 140. It should be born in mind that the outer seal 64 will prevent pressurized fluid vented through vent passage 140 from flowing into the downstream flow passage of the BOP body. Such vented pressure can only flow to the upstream portion of the flow passage 26.

After the rams of the BOP system have moved to the closed position thereof and the spaced inner sealing elements of the rams have established mechanical sealing engagement with the wireline and grease has been injected into the chamber 106 to effect hydraulic sealing with the wireline, sealing of the BOP system is enhanced by well pressure. The well pressure acts on the elastomeric material from which the inner and outer seals are composed and causes the elastomeric material to be extruded to some extent. This extrusion activity causes the inner and outer sealing elements to bulge or become deformed to some extent, thereby establishing a tighter sealing engagement with the respective internal surfaces of the BOP body structure and with the wireline. Of course this bulging or pressure energized deformation of the sealing element develops relatively high friction forces between the BOP rams and body. These frictional forces effectively resist opening movement of the rams.

It is frequently necessary with wireline BOPs to equalize pressure across the seal established between the wireline and the closed BOP rams such as for conducting particular downstream wireline barrel operations and especially to prepare the closed BOP rams for opening. As mentioned above, it is typically difficult to move the rams against high differential pressures. Accordingly, wireline BOPs must be provided with a bypass that is used to equalize the pressure across the rams before reopening. Upon equalization of well pressure across the seals developed by the closed BOP rams, pressure downstream of the rams will be contained by the wireline barrel and a partial relaxation of the BOP seals will occur thus eliminating pressure extrusion of the elastomeric sealing material of the rams about the irregular outer surface of the wireline and against the cylindrical inner surfaces of the ram housings and consequently reducing the friction of the rams against the internal wall surfaces of the BOP body structure. This effective reduction of friction minimizes the force that is necessary to open the rams.

As shown in FIG. 2, a BOP pressure equalizing system is illustrated generally at 142. A pair of pressure equalizing fittings 144 and 146 form externally threaded connectors 148 and 150 that are received by internally threaded ports or passages 152 and 154 which are in communication respectively with the flow passage 26 of the BOP body structure above and below the seals effected between the rams 28 and 30 and the wireline. The fittings 144 and 146 are sealed with respect to the body 12 by means of circular sealing elements 156 and 158 and form internal equalization passages 160 and 162. The equalization fittings are preferably defined by bolt like structures which are threaded into the ports 152 and 153. Each of the equalization fittings forms an external peripheral groove 164 and 166 and transverse passages 168 and 170 that communicate these annular grooves with the respective equalization passages 160 and 162. The bolt-like pressure equalization fittings secure connector sleeves 172 and 174 tightly against the BOP body structure 12 and in sealed relation about the fittings, with sealing being established by a plurality of spaced O-Ring or other suitable sealing elements. A bridging conduit 176 having a passage 178 extending therethrough is disposed in sealed relation with the sleeve elements 172 and 174 and functions to permit sufficient flow of fluid to equalize pressure in the passages 160 and 162.

The fittings 144 and 146 differ in that fitting 146 is an equalizing valve and defines a valve chamber 180 having a valve seat 182 adapted to receive a needle valve element 184 in sealing relation therewith. The needle valve is shown in its open position permitting pressure equalization and is designed for sealing closure of its tapered sealing end against the tapered valve seat 182 through adjustment of its threaded end 186 relative to the body structure of the fitting. The threaded end 186 may define a receptacle to receive an allen wrench, screw driver or any other suitable tool to thus enable personnel to manipulate the needle valve by rotating it and driving it linearly between its open and closed positions. Obviously, during normal operations the needle valve 184 will be seated against the valve seat 184 and thus closed, preventing pressure transfer across the seals of the wireline BOP.

After the rams of the BOP have been moved to their respective closed positions to effect a mechanical seal with the wireline and the BOP body structure and grease or other suitable sealant has been injected into the grease sealing chamber 106 the wireline BOP structure with this invention will have developed a mechanical seal and a hydraulic seal with the wireline and will effectively prevent leakage of pressure through the interstices of the wireline. These features are effectively accomplished even though the BOP structure of this invention incorporates only a single pair of sealing rams.

To reduce the friction of the rams and thus permit ease of moving the rams from the closed position to the open position, the equalizing valve assembly is operated to its open position by rotating threaded end 186 of the needle valve 184. Pressure downstream of the BOP seal will then be transferred by the equalizing valve assembly to the downstream side thereof where it is contained by the wireline barrel or by surface equipment of a wellhead assembly. After pressure equalization the rams are then opened manually such as by rotation of the actuator handles 43 or by imparting controlled operation to a hydraulically energized BOP operator as the case may be.

It should be born in mind that the wireline BOP system set forth herein is unidirectional and therefore must be installed with the outer seals 64 facing upwardly as shown in FIG. 1. If installed in reverse manner, the BOP will not contain well pressure even though it would contain the pressure of fluid injected into the well. However, wireline BOPs are provided as well safety devices for containing well pressure and are always installed in the position shown in FIGS. 1 and 2.

In view of the foregoing it is clear that a single ram type wireline BOP system has been presented herewith which effectively achieves both mechanical and hydraulic seals with respect to the wireline and thus effectively prevents leakage of fluid through the interstices of the wireline. The single rams, when closed, cooperate to form a hydraulic chamber or grease sealing chamber of small dimension which receives injected grease between upper and lower inner seals of the rams. Grease or other sealing material is injected from a supply source. The apparatus incorporates a relief valve system which relieves excessive pressure in the grease chamber 106. The BOP system of this invention incorporates a pressure equalization valve assembly which is utilized to reduce the friction between the rams and the body structure of the BOP thus insuring ease of ram opening movement.

While the foregoing is directed to the preferred embodiment, the scope thereof is determined by the claims which follow.

What is claimed is:

1. A single ram unidirectional wireline BOP system having mechanical and hydraulic sealing capability with respect to a wireline that is movable therethrough and which forms interstices between armor strands thereof, comprising:

(a) a BOP body having a vertical flow passage and forming a pair of opposed horizontal ram passages;

(b) a pair of rams being movably disposed within said ram passages, each of said rams forming a face surface and having an elastomeric outer seal establishing an outer peripheral seal between said rams and said BOP body and a pair of vertically spaced elastomeric inner sealing elements projecting beyond said face surface and adapted for sealing engagement with one another and with the wireline, said rams being movable to open positions wherein said inner sealing elements are positioned away from said wireline and closed positions where said face surfaces of said rams are disposed in spaced relation with one another and said inner sealing elements of said rams establish mechanical sealing engagement with said wireline, in said closed positions of said rams the space between said vertically spaced elastomeric inner sealing elements and the space between said face surfaces of said rams forming a grease sealant chamber through which said wireline extends;

(c) means imparting movement of said rams to said open and closed positions; and (d) means for conducting injected grease sealant into said grease sealant chamber at sufficiently high pressure to establish hydraulic sealing with said wireline in said grease sealant chamber to prevent leakage of fluid pressure through said interstices of said wireline.

2. The single ram unidirectional wireline BOP system recited in claim 1, wherein:

(a) said BOP body forms a grease injection port in communication with said grease sealant chamber; and (b) a unidirectional grease fitting being secured to said BOP body at said grease injection port and providing for said conducting injected grease sealant into said grease chamber.

3. The single ram unidirectional wireline BOP system recited in claim 2, wherein:

said unidirectional grease fitting incorporates a check valve therein permitting injection of grease through said grease fitting into said grease chamber and preventing the flow of grease from said grease sealant chamber through said check valve in the opposite direction.

4. A single ram unidirectional wireline BOP system having mechanical and hydraulic sealing capability with respect to a wireline that is movable therethrough and which forms interstices between armor strands thereof, comprising:

(a) a BOP body having a vertical flow passage and forming a pair of opposed horizontal ram passages;

(b) a pair of rams being movably disposed within said ram passages, each of said rams forming a face surface and having an elastomeric outer seal establishing an outer peripheral seal between said rams and said BOP body and a pair of vertically spaced elastomeric inner sealing elements projecting beyond said face surface and adapted for sealing engagement with one another and with the wireline, said rams being movable to open positions wherein said inner sealing elements are positioned away from said wireline and closed positions where said free surfaces of said rams are disposed in inner sealing elements of said rams establish mechanical sealing engagement with said wireline said closed positions of said rams the space between said vertically spaced elastomeric inner sealing elements and the space between said face surfaces of said rams forming a grease sealant chamber through which said wireline extends;

(c) means imparting movement of said rams to said open and closed positions;

(d) means for conducting injected grease sealant into said grease sealant chamber at sufficiently high pressure to establish hydraulic sealing with said wireline in said grease sealant chamber to prevent leakage of fluid pressure through said interstices of said wireline; and (e) pressure equalizing means being in communication with said vertical flow passage upstream and downstream of said inner sealing elements and being controllable to selectively bypass fluid pressure past said inner sealing elements when said rams are at said closed positions thereof for establishing said mechanical sealing engagement with said wireline.

5. The single ram unidirectional wireline BOP system recited in claim 4, wherein:

said pressure equalization system incorporates a valve which is opened to permit said bypass of fluid pressure past said inner sealing elements and which is closed to prevent said bypass of fluid pressure past said inner sealing elements.

6. The single ram unidirectional wireline BOP system recited in claim 4, wherein:

(a) said BOP body defines a pair of spaced pressure equalization ports;

(b) a pair of pressure equalization fittings are secured to said BOP body at said pressure equalization ports and define pressure equalization passage means; and (c) pressure transfer means defining a passage interconnecting said pressure equalization fittings and communicating fluid pressure between said pressure equalization passages thereof.

7. The single ram unidirectional wireline BOP system recited in claim 6, wherein:

(a) a valve chamber and valve seat are defined by one of said pressure equalization fittings at said pressure equalization passage thereof; and (b) a pressure equalization valve is selectively movable to an open position within said valve chamber to permit the flow of fluid past said valve seat and is movable to a closed position where said equalization valve engages said valve seat and prevents the flow of fluid past said valve seat.

8. The single ram unidirectional wireline BOP system recited in claim 4, wherein:

(a) said pressure equalization fittings define external grooves disposed in fluid communication with said pressure equalization passages;

(b) a pair of sleeve elements being positioned about portions of said pressure equalization fittings and having sealing relation therewith on each side of said peripheral groove; and (c) a fluid transfer tube being connected in sealed relation with said sleeve elements and conducting fluid pressure between said external grooves.

9. A single ram unidirectional wireline BOP system having mechanical and hydraulic sealing capability with respect to a wireline that is movable therethrough and which forms interstices between armor strands thereof, comprising:

(a) a BOP body having a vertical flow passage and forming a pair of opposed horizontal ram passages;

(b) a pair of rams being movably disposed within said ram passages, each of said rams forming a face surface and having an elastomeric outer seal establishing an outer peripheral seal between said rams and said BOP body and a pair of vertically spaced elastomeric inner sealing elements projecting beyond said face surface and adapted for sealing engagement with one another and with the wireline, said rams being movable to open positions wherein said inner sealing elements are positioned away from said wireline and closed positions where said free surfaces of said rams are disposed in inner sealing elements of said rams establish mechanical sealing engagement with said wireline said closed positions of said rams the space between said vertically spaced elastomeric inner sealing elements and the space between said face surfaces of said rams forming a grease sealant chamber through which said wireline extends;

(c) means imparting movement of said rams to said open and closed positions;

(d) means for conducting injected grease sealant into said grease sealant chamber at sufficiently high pressure to establish hydraulic sealing with said wireline in said grease sealant chamber to prevent leakage of fluid pressure through said interstices of said wireline; and (e) at least one of said rams defining a pressure relief system in communication with said grease sealant chamber and being operative to relieve excess fluid pressure from said grease sealant chamber to said vertical flow passage upstream of said inner sealing elements.

10. The single ram unidirectional wireline BOP system recited in claim 9, wherein each of said rams incorporates a pressure relief system and each pressure relief system comprises:

(a) a vent passage extending through said ram and having one end thereof in communication with said grease chamber and the other end thereof terminating at an upstream portion of said ram; and (b) a pressure relief valve being disposed within said ram and being operative to control relief of pressure from said grease chamber above a predetermined pressure.

11. The single ram unidirectional wireline BOP system recited in claim 9, wherein:

(a) said one ram forms an internal relief valve chamber having a valve seat intersecting said relief passage and forms vent passage means communicating said relief valve chamber with said grease sealant chamber and with said vertical flow passage upstream of said inner sealing elements;

(b) a relief valve element being movably disposed within said valve chamber and adapted for sealing engagement with said valve seat; and (c) means urging said relief valve element against said valve seat with sufficient force to maintain said valve element in sealed relation with said valve seat until said predetermined pressure is exceeded.

12. The single ram unidirectional wireline BOP system recited in claim 11, wherein:

(a) said ram defines an internal cylindrical wall forming a portion of said relief valve chamber; and (b) said relief valve having a piston disposed in sealed relation with said cylindrical wall and defining a pressure responsive area being acted upon by fluid pressure within said relief valve chamber to develop a pressure induced force imparting opening movement to said relief valve against the force of said urging means.

13. The single ram unidirectional wireline BOP system recited in claim 12, including:

retainer means being secured to said ram body and retaining said relief valve and said urging means within said ram body.

14. The single ram unidirectional wireline BOP system recited in claim 13, wherein:

(a) said relief valve element defines a guide stem extending rearwardly therefrom;

(b) said urging means being compression spring means being disposed about said guide stem; and (c) said retainer means being a circular retainer having a central opening receiving said guide stem of said relief valve and having external threaded connection with said ram body, said retainer means being adjustable for controlling the compression of said compression spring means.

15. A method of establishing a mechanical seal and a hydraulic seal between the opposed rams of a single ram unidirectional wireline BOP system having upper and lower internal sealing elements for establishing spaced mechanical sealing with a wireline forming interstices between the armor strands thereof, said upper and lower internal sealing elements when in sealing relation with said wireline, establishing a grease chamber therebetween, said method comprising:

(a) imparting closing movement to said rams thus bringing said upper and lower internal sealing elements of said rams into mechanical sealing engagement with one another and mechanical sealing engagement with said wireline;

(b) injecting a quantity of grease through said BOP body into said grease chamber for establishment of hydraulic interstitial sealing with said wireline to prevent leakage of fluid pressure through said interstices; and (c) relieving excess grease pressure from said grease chamber through relief passage means in at least one of said rams at pressures above a predetermined pressure.

16. The method of claim 15, including:

(a) establishing equalized pressure within the flow passage of said BOP and across said inner seals to reduce frictional resistance to movement of said rams; and (b) imparting opening movement to said rams.

17. A single ram unidirectional wireline BOP system having mechanical and hydraulic sealing capability, comprising:

(a) a BOP body having a vertical flow passage and forming a pair or tubular housings defining opposed horizontal ram passages;

(b) a pair of rams being movably disposed within said ram passages, each of said rams forming a face surface and having an elastomeric outer seal establishing an outer peripheral seal between said rams and said BOP body and a pair of vertically spaced elastomeric inner sealing elements extending beyond the respective face surface and adapted for mechanical sealing engagement with a wireline, said rams being movable to an open position wherein said elastomeric inner sealing elements are positioned away from said wireline and a closed position wherein said inner sealing elements of said rams establish sealing engagement with said wireline and said face surfaces of said rams are disposed in spaced relation, at said closed position of said rams the space between said vertically spaced elastomeric inner sealing elements and the space between said face surfaces of said rams define a grease sealing chamber through which said wireline extends;

(c) means imparting movement of said rams to said open and closed positions;

(d) means for injecting grease sealant into said grease sealant chamber at sufficiently high pressure to establish hydraulic sealing with said wireline in said grease sealant chamber to prevent interstitial leakage of fluid pressure through said interstices of said wireline and past the mechanical seals between said elastomeric inner sealing elements and said wireline; and (e) means for relieving excess grease pressure in said grease sealant chamber through at least one of said pair of rams to said vertical flow passage upstream of the mechanical and hydraulic seals between said rams and said wireline.

18. The single ram unidirectional wireline BOP system recited in claim 17, including:

pressure equalization means being selectively operable for equalizing pressure within said flow passage and above and below the seals of said rams with said wireline.

* * * * *